US006261658B1

(12) United States Patent
Schmidt

(10) Patent No.: US 6,261,658 B1
(45) Date of Patent: Jul. 17, 2001

(54) STANDABLE STICKERS AND METHOD AND APPARATUS FOR MANUFACTURING SAME

(75) Inventor: Charles W. Schmidt, Barrington, IL (US)

(73) Assignee: Allied Graphics, Inc., Buffalo Grove, IL (US)

( * ) Notice: Subject to any disclaimer, the term of this patent is extended or adjusted under 35 U.S.C. 154(b) by 0 days.

(21) Appl. No.: 08/961,708

(22) Filed: Oct. 31, 1997

(51) Int. Cl.[7] ..... G09F 1/14

(52) U.S. Cl. ..... 428/40.1; 40/124.08; 40/594; 40/638; 40/660.09; 283/81; 428/8; 428/9; 428/12; 428/15; 428/42.1; 428/43; 428/121; 428/130; 428/192

(58) Field of Search ..... 428/40.1, 42.1, 428/42.2, 42.3, 41.3, 41.4, 41.5, 41.8, 343, 43, 8, 9, 12, 119, 15, 121, 130, 192; 40/124.08, 638, 594, 124.14, 530, 661.09; 283/81

(56) References Cited

U.S. PATENT DOCUMENTS

| | | | | |
|---|---|---|---|---|
| 3,600,812 | | 8/1971 | Cromoga | 33/74 |
| 4,726,972 | | 2/1988 | Instance | 428/40 |
| 4,867,480 | * | 9/1989 | Volkert | 283/117 |
| 4,879,823 | | 11/1989 | Collins | 40/124.1 |
| 4,968,540 | | 11/1990 | Linsenbigler | 428/5 |
| 5,022,681 | * | 6/1991 | Penick | 281/15.11 |
| 5,083,961 | | 1/1992 | Ishiwa | 446/75 |
| 5,157,852 | | 10/1992 | Patrou et al. | 40/160 |
| 5,317,823 | | 6/1994 | Brunt, II | 40/124.1 |
| 5,345,705 | | 9/1994 | Lawrence | 40/616 |
| 5,582,888 | * | 12/1996 | Volkert | 428/40.1 |
| 5,628,846 | * | 5/1997 | Huss et al. | 156/70 |
| 5,691,022 | * | 11/1997 | Knauf | 428/40.1 |
| 5,691,023 | * | 11/1997 | Keller | 428/43 |
| 5,799,424 | * | 9/1998 | Volkert et al. | 40/124.08 |
| 5,851,617 | * | 12/1998 | Keiser | 428/41.8 |
| 5,989,667 | * | 11/1999 | Tayebi | 428/40.1 |

* cited by examiner

*Primary Examiner*—Nasser Ahmad
(74) *Attorney, Agent, or Firm*—Wallenstein & Wagner

(57) ABSTRACT

A standable sticker is provided comprising an integral one-piece shape that is divided into a figure portion and a base portion. The base portion is adapted for permanent or removable adherence to a surface, and is coated on one side with a pressure sensitive adhesive. A perforated or scored line defines a boundary between the figure portion and base portion and the figure portion in foldable at an angle to the base portion at the perforated or scored line to permit the figure portion to be presented in a substantially vertical orientation. The sticker is adapted for releasable adhesion to liner material or substrate.

12 Claims, 12 Drawing Sheets

STANDABLE STICKERS AND METHOD AND APPARATUS FOR MANUFACTURING SAME

TECHNICAL FIELD

The present invention relates to pressure sensitive stickers having graphic designs and, more particularly, to stickers that are standable on a surface so as to present an erect, three-dimensional perspective of the graphic designs, and stickers that may be either permanently adherable to the surface or removable from and reattachable to the surface.

BACKGROUND OF THE INVENTION

Stickers have a wide variety of informational, educational and entertaining uses, particularly for children. Conventionally, stickers are effectively two-dimensional from a perspective view in that they lay flat when adhered to a surface. For some purposes such as creating a diorama having depth and perspective, however, it is desirable to present stickers in a three-dimensional manner. That is, there is a need for stickers that have graphic designs printed thereon and are self-standable in a substantially vertical orientation. There is also a need for self-standable stickers that are repositionable on a surface without sacrificing their adherent characteristics. The present invention provides standable, pressure sensitive stickers for permanent or repositionable adherence to a display surface, and methods and apparatus for manufacturing them.

SUMMARY OF THE INVENTION

A standable sticker is provided comprising an integral one-piece shape that is divided into a figure portion and a base portion. The base portion is adapted for adherence to a surface, and is coated on one side with a pressure sensitive adhesive. A perforated or scored line defines a boundary between the figure portion and the base portion, and the figure portion is foldable at an angle to the base portion at the defined line. This permits the figure to be presented in a substantially vertical orientation.

In another embodiment, a group of stickers are provided on a liner material or substrate. The stickers are adapted to be released from the liner material and transferred to a coated display surface on which the stickers may be arranged in repositionable configurations.

The present invention also provides processes for manufacturing the stickers described above. In a first process, a length of base material is passed through an adhesive coater to apply one or more pressure sensitive adhesive strips to a first side of the base material, such that the first side has a non-adhesive region adjacent the adhesive strip or strips. A laminate is produced by applying a length of releasable liner material to the first side. The laminate is either passed through a corona treater or chemically treated in a top-coating process, to permit a second side of the base material to accept ink. The laminate is then passed through one or more print decks to create one or more images on the non-adhesive region. The laminate subsequently undergoes a series of finishing steps. A die-cutting station produces outlines on the laminate. Each outline circumscribes an image that defines a figure portion and an area of the adhesive strip that defines a base portion. The same die-cutting station also produces perforated lines along an edge defined between the non-adhesive region and the adhesive strip. Alternatively, a separate scoring station produces scored lines. A sheeting station cuts the length of laminate into discrete sheets.

In a second process for manufacturing standable stickers, a length of base material is either passed through a corona treater or chemically treated in a top-coating process to permit a print side of the base material to accept ink. The base material is passed through one or more print decks to create predetermined images on the print side, each image defining a figure portion. The base material is then passed through a coating station to apply a pattern of pressure sensitive adhesive coating to predetermined regions of a first side of the base material. Each region defines a base portion, and each base portion abuts an edge of a corresponding one of the figure portions. A laminate is produced by applying a length of releasable liner material to the first side. The laminate is passed through a die-cutting station to cut outlines into the base material. Each outline defines a sticker, and each sticker includes one of the figure portions and a corresponding one of the base portions, with pressure sensitive adhesive on the base portion but not on the figure portion. Perforated or scored lines are produced on the laminate as in the first method, each score line being one of demarcation and substantially coincident with a corresponding one of the edges of the figure portions. A sheeting station is then employed to cut the laminate into discrete sheets.

In another process for manufacturing standable stickers, a length of base material is passed through a print deck to print predetermined images on a back side of the base material. Die patterns are then produced on a front side of the base material. The die patterns are in register with corresponding images on the back side. A composite is produced by applying a length of laminate material to the back side of the base material. A pattern of pressure sensitive adhesive regions is applied to the laminate material. A length of releasable liner material is then applied to the laminate material. The composite is passed through a die-cutter to define figure portions and corresponding base portions on the composite. Each figure portion includes at least one of the graphic images, and each base portion includes one of the adhesive regions. A plurality of perforated or scored lines are produced on the composite. Each line defines a boundary between one of the figure portions and a corresponding one of the base portions. The composite is then cut into a finished sheet having a total area less than a total area of the initial sheet.

The present invention is also directed to apparatus employed in the practice of the processes herein described.

Other features and advantages of the invention will be apparent from the following specification taken in conjunction with the following drawings.

DETAILED DESCRIPTION OF THE PREFERRED EMBODIMENTS

Figure 1:
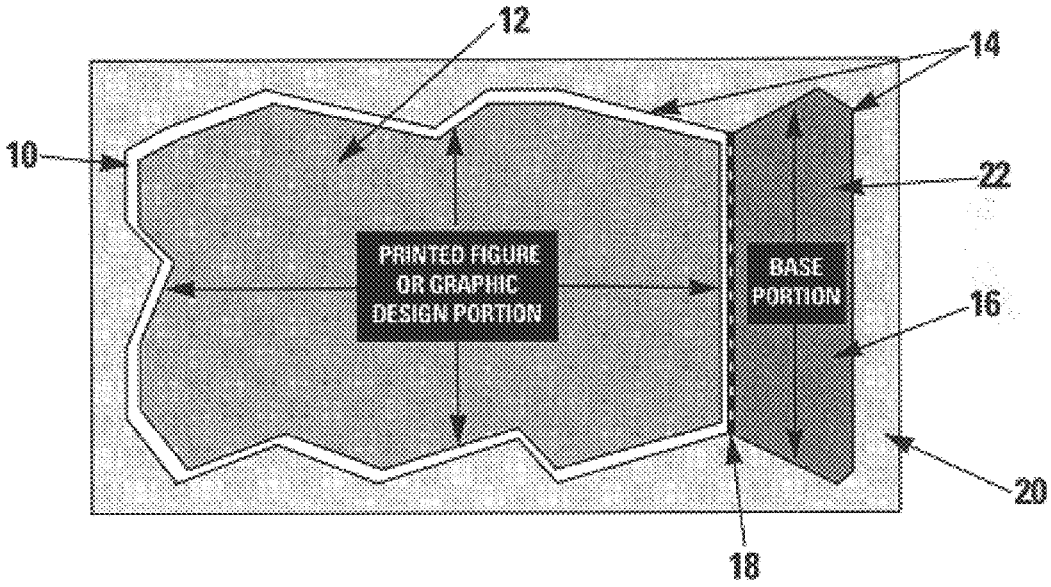
FIG. 1 is a top view of a sticker according to the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
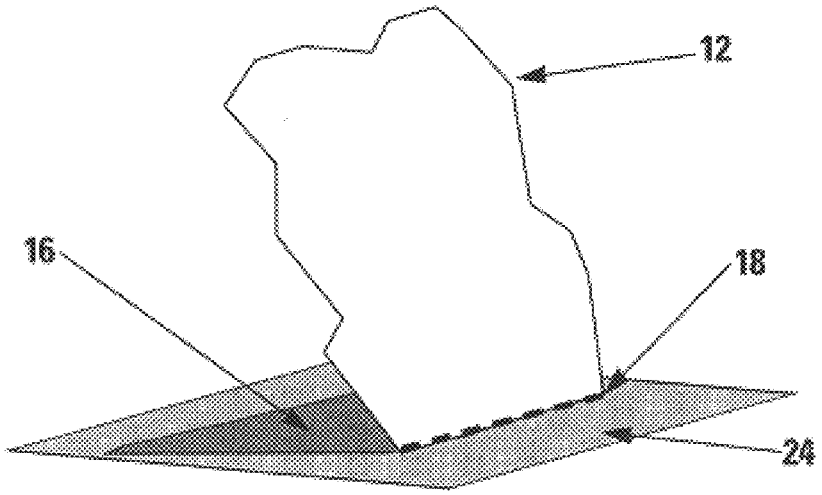
FIG. 2 is a perspective view of the sticker of FIG. 1 in a standing position.

FIGS. 1 and 2 show a sticker according to a preferred embodiment of the present invention. The sticker 10 includes a printed figure or graphic design portion 12 designed for presentation in a standing orientation, such as a substantially vertical position with respect to a horizontal. The sticker 10 may be constructed of a cellulosic based (i.e., paper), a polymeric based (i.e., plastic) material, a composite thereof, and is preferably rigid. Various types of objects, characters or text may be printed on the figure portion 12. In addition, the figure portion 12 has a die-cut outline or periphery 14, the shape of which is chosen as appropriate to enhance the image or information printed on the figure portion 12. Integral with the figure portion 12 is a tab or base portion 16. A perforated or scored line 18 defines a boundary between the figure portion 12 and base portion 16. Preferably, the line 18 is perforated with one or more perforations rather than scored. The sticker 10 is adhered to a substrate or liner material 20 that serves as a storage or holding medium. The sticker 10 is removable from the liner material 20. Silicone treated paper has been found suitable for use as the liner material 20.

To present the sticker 10 in a substantially vertical orientation, i.e., in a three-dimensional manner, the sticker 10 is peeled from the liner material 20. The base portion 16 is folded at an angle from the figure portion 12 at the perforated or scored line 18 such that the base portion 16 serves as a supporting base or foot for the figure portion 12. In the embodiment shown in FIGS. 1 and 2, one side 22 of the base portion 16 is treated with a pressure sensitive adhesive and the sticker 10 is placed on a display surface 24. To facilitate and enhance the free-standability of the sticker 10, the display surface is preferably coated with an aqueous coating and a top liquid coating such as unsaturated oligomeric acrylate that is photo initiated, i.e., cured by an ultraviolet ("U.V.") source. This material is distributed by Kelstar in Cinnaminson, N.J., under the trade name "Ultra Sheen", Model No. UV-32EC. The sticker 10 may be repeatedly removed from the liner material 20, folded at the score line 18, placed on the coated surface 24, removed from the coated surface 24, unfolded and returned to the liner material 20.

Figure 3:
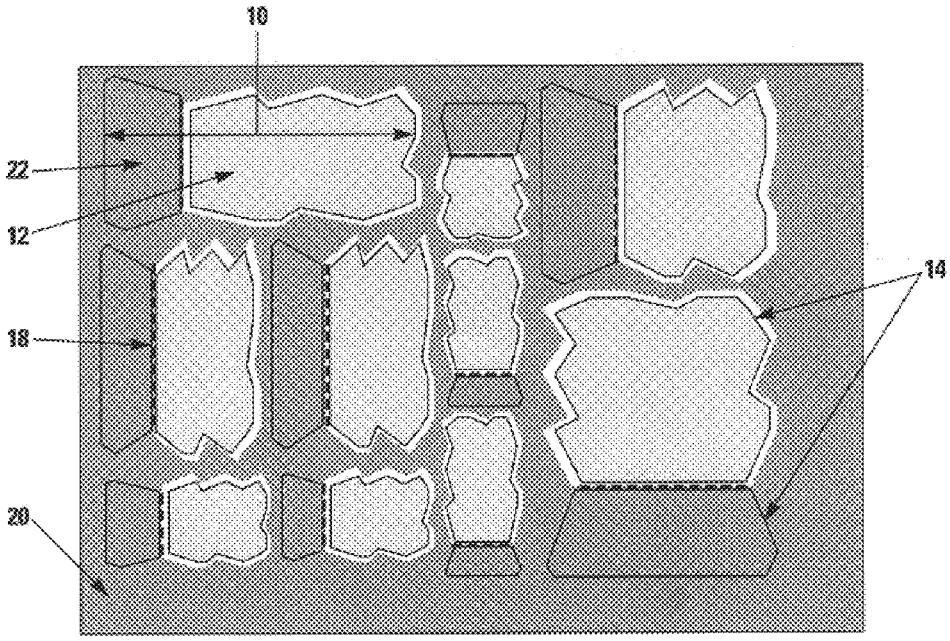
FIG. 3 is a top view of a set of stickers positioned on a substrate according to the present invention.
Figure 4:
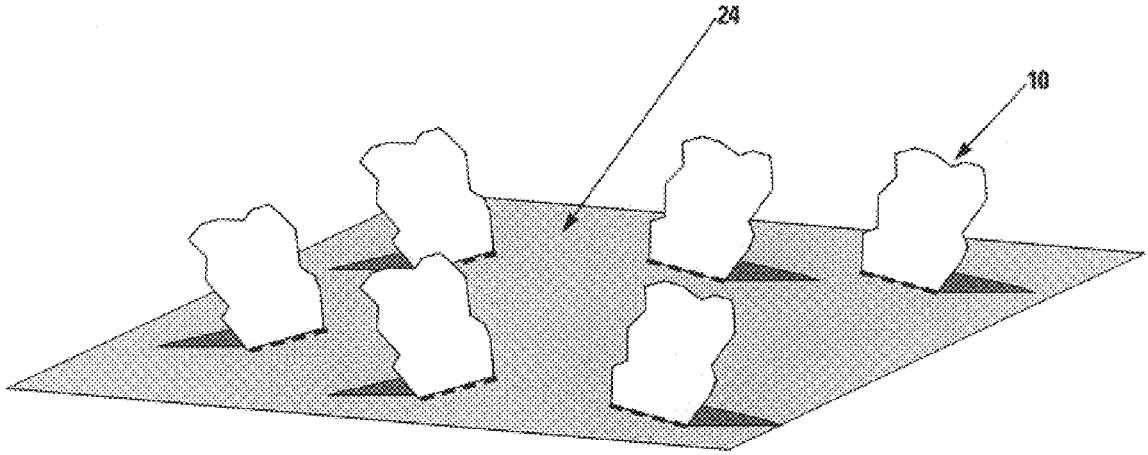
FIG. 4 is a perspective view of a group of stickers arranged on a coated surface.

FIGS. 3 and 4 show another preferred embodiment according to the present invention. A plurality of stickers 10 are provided as a thematically-related, integrated set on one or more sheets of liner material 20. The stickers 10 have varied sizes, images, and die-cut shapes or outlines 14. The stickers 10 are removable from the liner material 20 and positionable in various combinations on the coated display surface 24 provided with the stickers 10. The display surface 24 may be printed in a background scenario or graphic format consistent with the theme expressed by the graphic images or text of the stickers 10. As with the embodiment illustrated in FIGS. 1 and 2, the coating on the display surface 24 permits the stickers 10 to be repeatedly adhered and removed therefrom. Thus, a user may create various customized dioramas on the display surface 24 by repositioning and rearranging the stickers 10 a number of times.

Production Methods

Three preferred production methods for manufacturing the stickers 10 according to the present invention will now be described. The first and second methods take advantage of flexographic printing technology which enables printing with line screens of 133–150 dpi; the process is competitive with offset lithography line screens of 175–200 dpi. Generally, the first method is a two-step method that involves flexographic production on converted material. The second method is a one-step method that involves flexographic production with in-line adhesive coating. The third method contemplates offset printing combined with silk screen adhesive application and off-line finishing.

Method 1

Method 1 relies on flexographic production, which offers the intrinsic advantages of full color printing on a wide variety of possible substrates other than paper, as well as many different possible finishing operations. All steps involved may be accomplished in-line, preferably using rolls of material, but may generally be divided into two processes: a converting process and a flexographic printing process.

Figure 5:
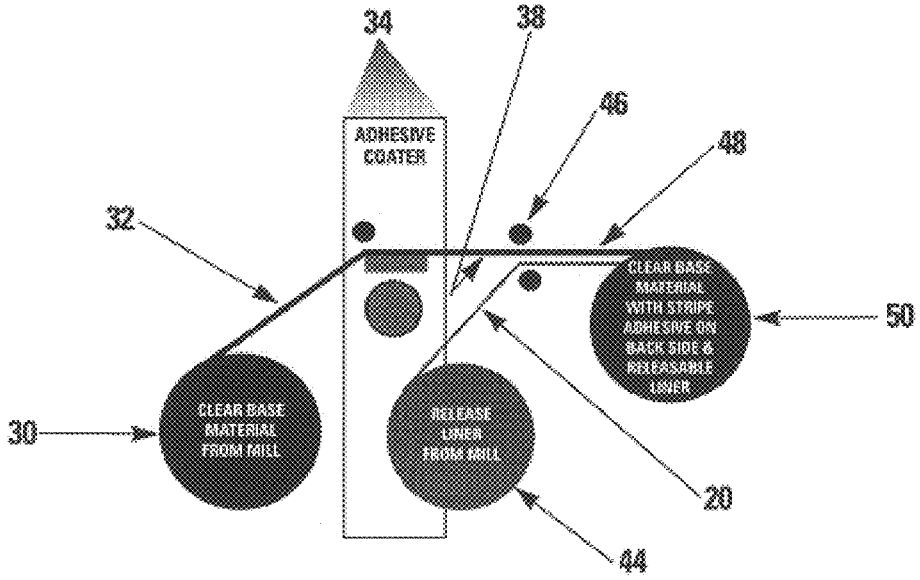
FIG. 5 is a diagrammatic view of adhesive coating apparatus in operation according to a first method of the present invention.
Figure 6:
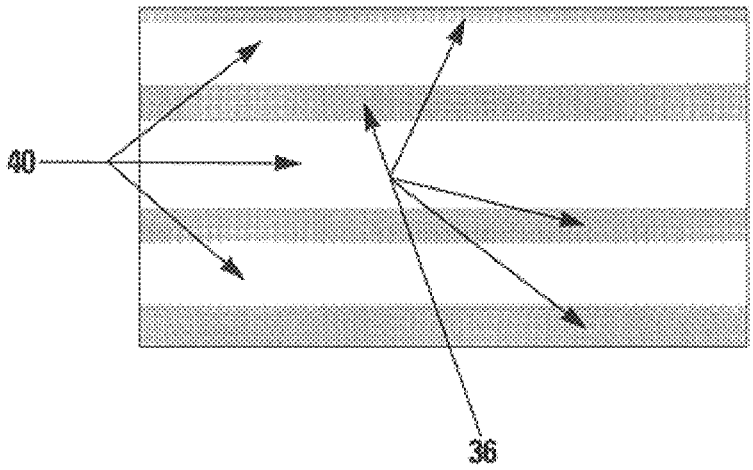
FIG. 6 is a view of the back side of a base material with adhesive stripping according to the first method of the present invention.

FIG. 5 illustrates the converting process and apparatus used therefor. A roll 30 of a base material 32 is provided. The base material 32 is preferably a clear plastic such as polyester having a thickness of five mils. A length of the base material 32 is unrolled and passed through an adhesive coater 34, which applies one or more longitudinal strips of pressure sensitive adhesive 36 to the back side 38 of the base material 32. As shown in FIG. 6, application of the adhesive results in the back side 38 having alternating adhesive strips 36 and non-adhesive areas or regions 40. In order to provide a substrate for the base material 32, a length of releasable liner material 20 is fed from a roll 44 to a pair of rollers 46 and applied to the back side 38 of the base material 32 to produce a laminate 48. The laminate 48 is then collected into a roll 50 and ready to be transferred to the flexographic printing process.

Figure 7:
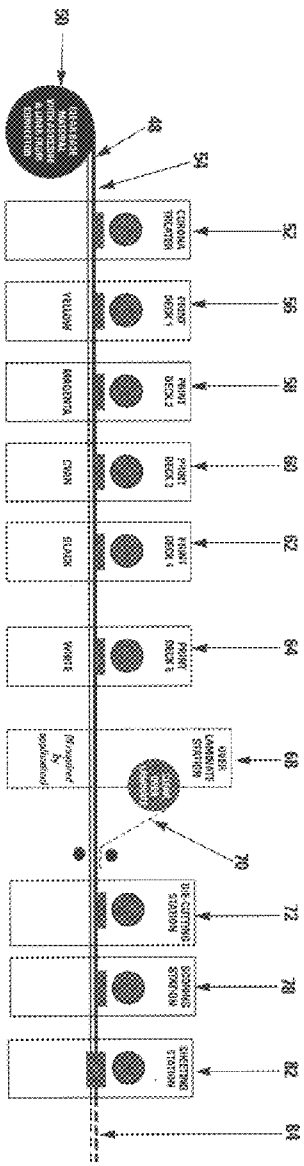
FIG. 7 is a diagrammatic view of a flexographic printing and finishing apparatus in operation according to the first method of the present invention.

FIG. 7 illustrates the flexographic printing process which, in the preferred embodiment, also includes the finishing steps described below. It is generally difficult to adhere ink to the base material 32 which, as described above, is preferably a plastic, because plastic is nonporous. Thus, a length of the laminate 48 is fed from the roll 50 through a corona treater 52 to apply a static electrical charge to the front or print side 54 of the base material 32 in order to enhance the ability of the print side 54 to accept ink printing. An alternative to employing the corona treater 52 is to chemically treat the print side 54 to accept ink ,i.e., "top coating" the print side with an overprint varnish such as one containing isopropyl alcohol and aqua ammonia. Using the corona treater 52, however, has been found to be more economical in the practice of the present invention.

Figure 8:
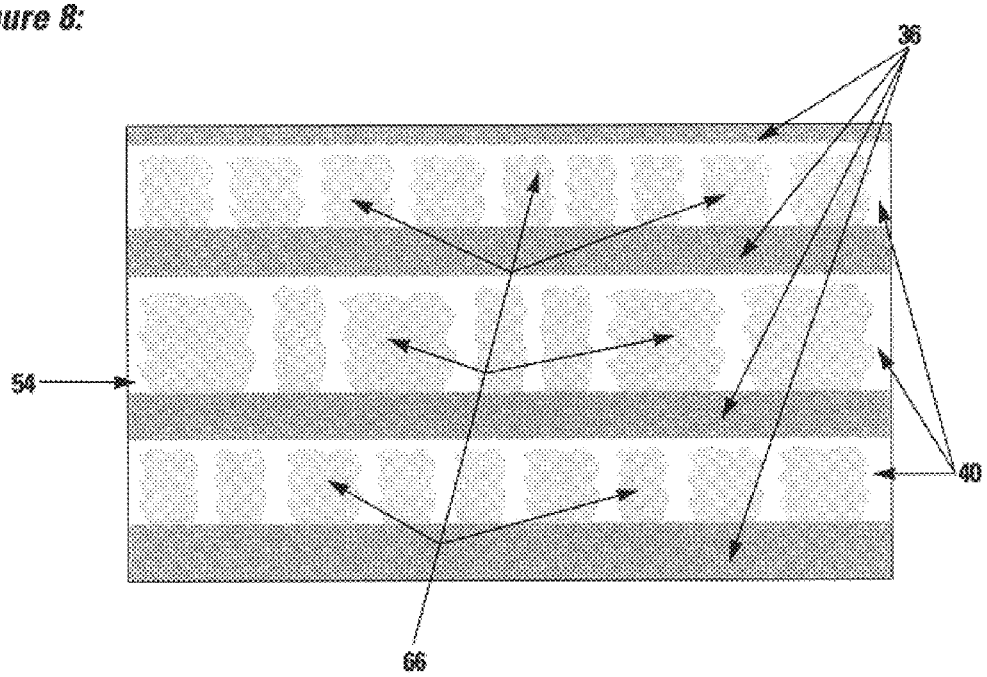
FIG. 8 is a view of the front side of a base material showing rows of graphic images printed thereon according to the first method of the present invention.
Figure 11:
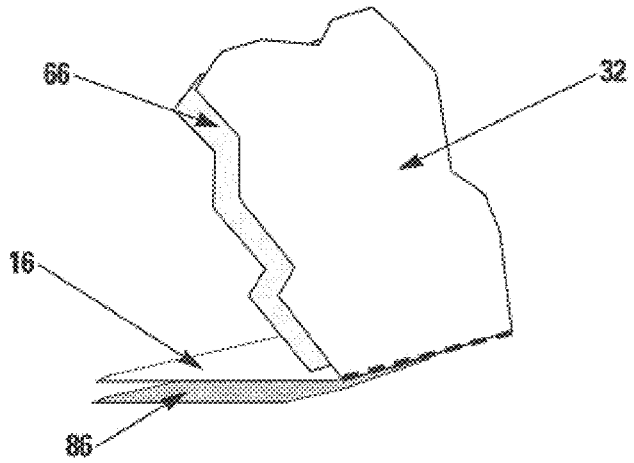
FIG. 11 is a perspective view of the sticker of FIG. 10 shown in a standing position.

The laminate 48 is then passed through at least one, but preferably a series of, print decks 56,58,60,62,64 to print predetermined information, figures or graphic images 66 on the print side 54. Each print deck 56,58,60,62,64 applies a single color of ink. As printed, the images 66 are reversed or mirrored —that is, the images 66 are created "face-down" with respect to the base material 32. Hence, when the finished sticker 10 is folded at the perforated or scored line 18 and vertically disposed in its standing position as shown in FIG. 11, the images 66 appear in correct orientation when viewed through the clear base material 32 in its finished state. Preferably, the last print deck, e.g., print deck 64 in the present embodiment, should overlay a white-colored ink application over the entire surface to increase opacity and create stronger viewing graphics. As shown in FIG. 8, the images 66 are created only on the non-adhesive regions 40 of the print side 54, and may vary with respect to size, shape and graphic design in a predetermined, repeatable pattern.

Once the printing process has been completed, the laminate 48 may, if required or desired, be run through an over-laminate station 68 to apply a clear over-laminate layer 70 to the print side 54 of the base material 32. The over-laminate layer 70 may serve to protect non-U.V. treated ink or to otherwise enhance quality and durability. In addition, the glossy surface of the over-laminate layer 70 may be considered to improve the aesthetic effects of the finished product.

Figure 9:
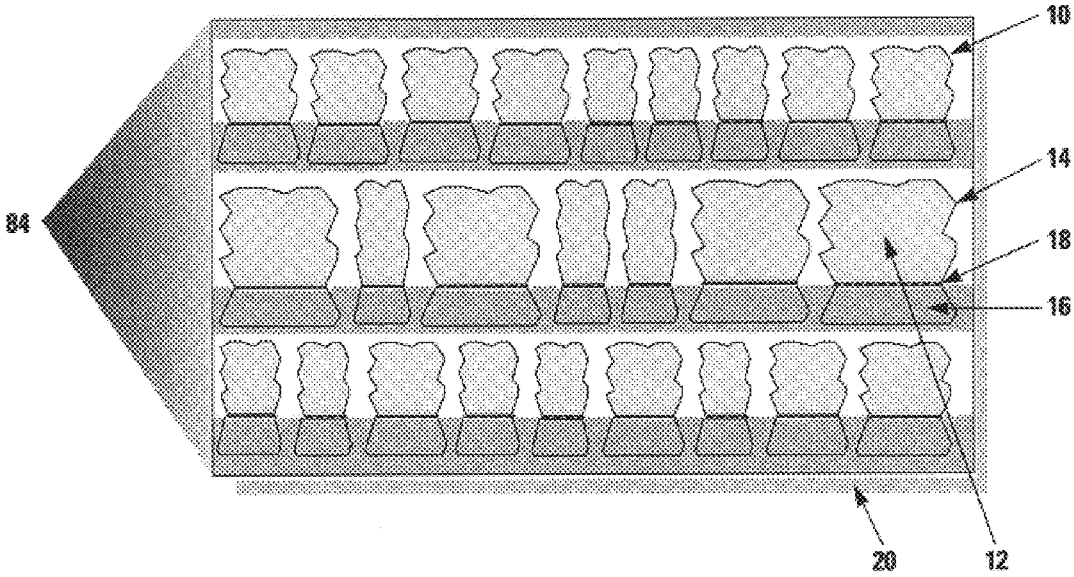
FIG. 9 is a view of the front side of the base material of FIG. 8 showing die-cut outlines and perforated or scored lines.

The printed laminate 48 is then subject to a series of finishing steps. The laminate 48 is passed through a diecutting station 72. As shown in FIG. 9, the die-cutting station 72 cuts outlines 14 into the base material 32 from its print side 54 about the periphery of the images 66 printed thereon to define figure portions 12. The outlines 14 are also cut into areas of the print side 54 directly opposite from the adhesive strips 36 on the back side 38 of the base material 32 to define base portions 16 immediately adjacent the figure portions 12, as also shown in FIG. 9. Although not shown in the Figures, it is preferable that the die or dies used to cut the outlines 14 be nicked so as to leave a narrow, continuous bridge of base material 32 joining each figure portion 12 to the uncut regions of the laminate 48. Such bridges afford the stickers 10 with a point of attachment to the laminate 48, thereby eliminating possible subsequent quality control problems, without affecting the ability of the end user to peel the finished stickers 10 from the liner material 20.

The die-cutting station 72 also creates perforated lines 18 between each corresponding pair of figure and base portions 12,16 to facilitate the foldability of the finished stickers 10. While the number of perforations will depend on the length of the line 18, it has been found sufficient to punch one or two perforations along the line 18. As an alternative to perforating the line 18 at the die-cutting station 72, the laminate 48 may be passed through a scoring station 78 that imparts a score along each line 18. However, perforating the line 18 is preferable since this eliminates the need for the scoring station 78. Also, better quality control has been observed in high-volume production runs when perforating is chosen in favor of scoring.

Finally, the laminate 48 is passed through a sheeting station 82 to create a plurality of laminate sheets 84 each having an identical grouping or arrangement of stickers 10. As described previously, each sheet 84 should contain a set of thematically related stickers 10. The sheets 84 will each have a length of 7.25" and a width of 4".

Figure 10:
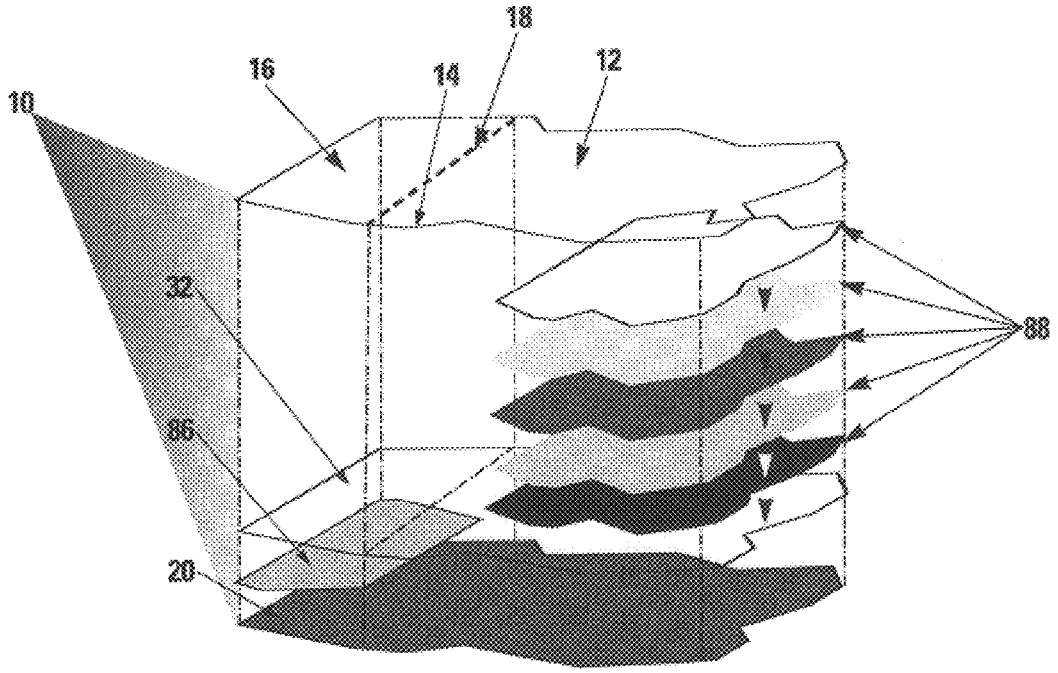
FIG. 10 is a diagrammatic view of a sticker constructed according to the first method of the present invention showing the relationships between layers, adhesive coating and color applications.

FIG. 10 diagrammatically summarizes the construction of the finished sticker 10 with its several layers shown in exploded view. As described, the base portion 16 of the base material 32 has an adhesive coating 86 cut from one of the adhesive strips 36. The several applications of ink colors 88 result in the figure or graphic image 66 imprinted on the figure portion 12. The finished sticker 10 is produced with the liner material 20 in releasable contact with the base portion 32.

It will be understood that as an alternative to employing discrete converting and flexographic printing processes, both processes may be carried out as a single, continuous, in-line process wherein the step of transferring the roll of converted laminate 50 from the converting equipment to the printing equipment is eliminated. The election of the one alternative in preference to the other will depend upon a number of factors having little immediate relevance to the present invention. However, both alternatives are intended to come within the scope of the invention.

Method 2

As with Method 1, Method 2 relies on flexographic production. However, Method 2 is more specifically intended to produce the stickers of the present invention in a single, continuous, in-line process.

Figure 12:
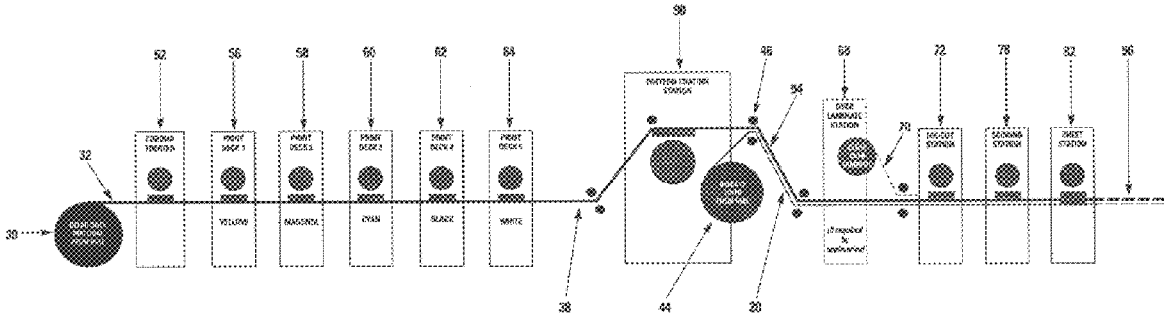
FIG. 12 is a diagrammatic view of in-line apparatus for producing stickers according to a second method of the present invention.
Figure 13:
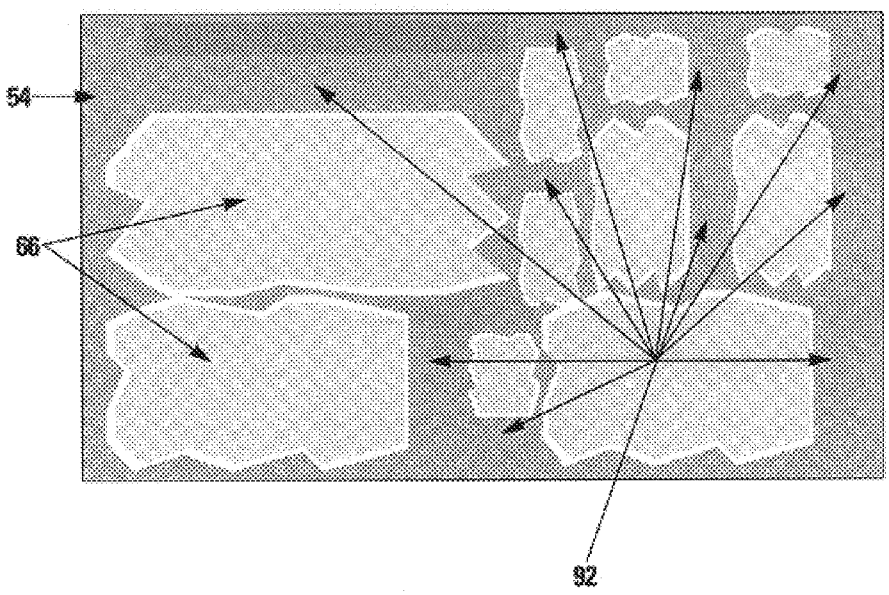
FIG. 13 is a view of the front side of a base material with a set of graphic images printed thereon according to the second method of the invention.

As shown in FIG. 12, a length of base material 32, preferably a clear, rigid plastic, is passed through flexographic printing apparatus similar to that used in Method 1 described above. That is, the corona treater 52 and one or more print decks 56,58,60,62,64 are employed to imprint informational or graphic images 66 on the base material 32, preferably at a resolution of 133–150 line screens. Again, the images 66 are printed in reversed or mirrored fashion so as to appear in correct form when the finished sticker 10 is displayed as in FIG. 11. The resulting set of images 66 printed on the top or print side 54 may differ in size, shape and graphic design, as shown in FIG. 13, and are grouped in predetermined, repeated patterns. As in Method 1, the corona treater 52 will be eliminated in the case where the print side 54 has been chemically treated to accept ink.

The printed base material 32 is then run through a pattern coating station 90 which applies a plurality of pressure sensitive adhesive coatings 86 to the back side 38 of the base material in a predetermined pattern corresponding to the images 66. In FIG. 13, reference numeral "92" designates the locations on the base material 32 at which the adhesive coatings 86 are applied in adjacent relation to the images 66. A releasable liner 20 comparable to that employed in Method 1 is then fed from a roll 44 to a pair of rollers 46 and applied to the back side 38 of the base material 32 to produce a laminate 94. As in Method 1, it may be desirable or necessary at this point to utilize an over-laminate station 68 to apply a clear over-laminate layer 70 to the print side 54.

Figure 14:
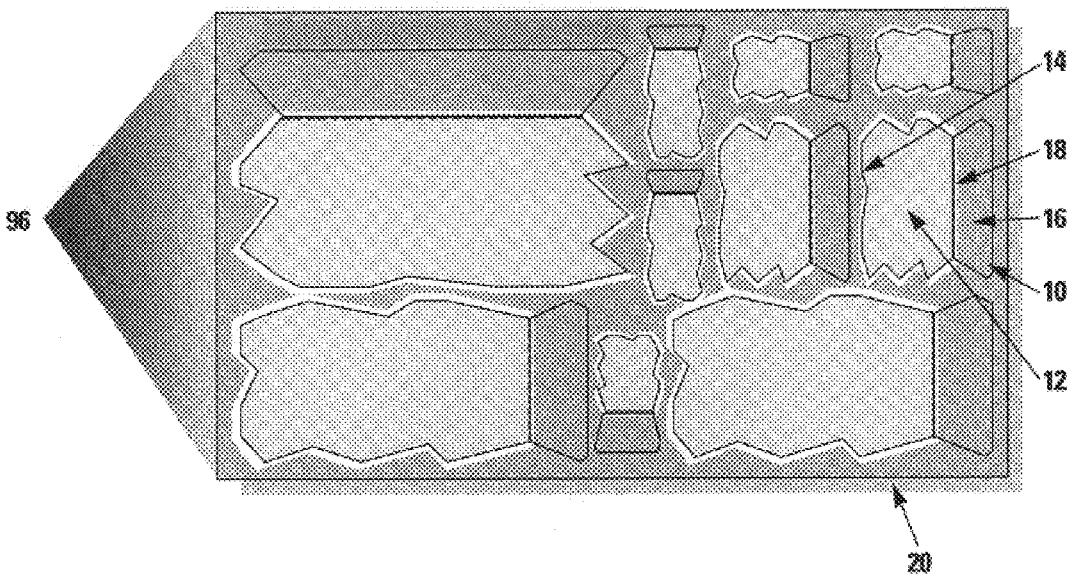
FIG. 14 is a view of the front side of the base material of FIG. 13 showing die-cut outlines and perforated or scored lines.

The subsequent finishing steps are analogous to those employed in Method 1, i.e., passing the laminate 94 through a die-cutting station 72 and a sheeting station 82. As before, the scoring station 78 is necessary only where the die-cutting station 72 has not been configured to produce perforations on the lines 18. In addition, the die or dies used at the die-cutting station 72 may be nicked so as to leave a narrow, continuous bridge (not shown) of the base material 32 joining each figure portion 12 to the uncut regions of the laminate 94. The resulting plurality of sheets 96 produced, shown in FIG. 14, include die-cut outlines 14 defining corresponding figure and base portions 12,16 separated by perforated or scored lines 18. The sheets 96 will typically each have a length of 7.25" and a width of 4". The construction of the finished stickers 10 may be diagrammatically summarized in a manner analogous to that depicted in FIG. 10 with respect to Method 1.

The one-step, in-line method of Method 2 provides certain advantages over Method 1. The ability to pattern coat pressure sensitive adhesive onto the base material 32 in-line while performing the printing steps lowers production costs and increases production flexibility. In addition, the fact that pattern coating involves applying the adhesive in direct, actual shapes permits more efficient use of materials, especially when the sizes and shapes of the figure portions 12 vary greatly. Moreover, registration of the printing to adhesive application to die-cutting steps is greatly improved since all steps are accomplished continuously and simultaneously. Thus far, Method 2 has been found superior to Method 1 in terms of cost and quality.

Method 3

The third method according to the present invention is generally a seven-step method that combines several production techniques used in different disciplines of the graphic arts. Unlike the first two flexographic methods described above, the Method 3 entails offset lithographic printing of images 66 on a cellulosic based material such as paper rather than on a clear polymeric based material. In addition, the third method operates on sheets of materials rather than the rolls of the flexographic methods.

Figure 15:
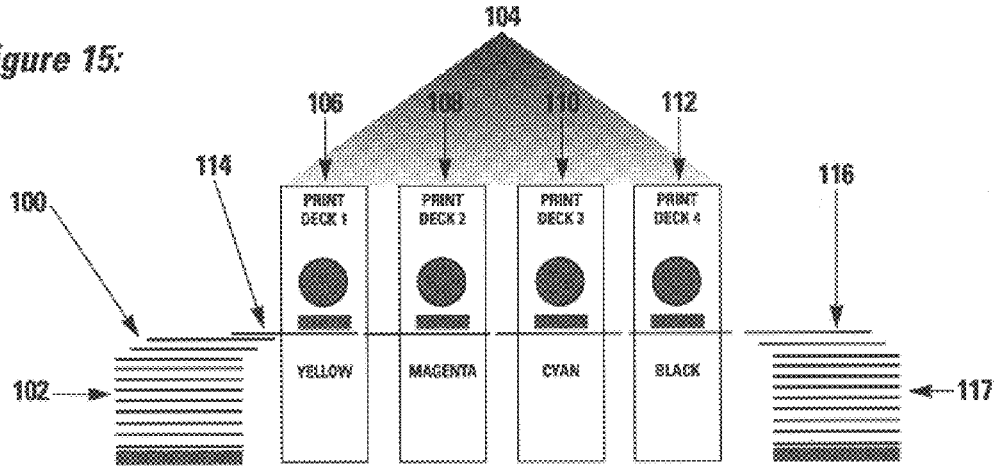
FIG. 15 is a diagrammatic view of offset lithographic apparatus in operation according to a third method of the present invention.
Figure 16:
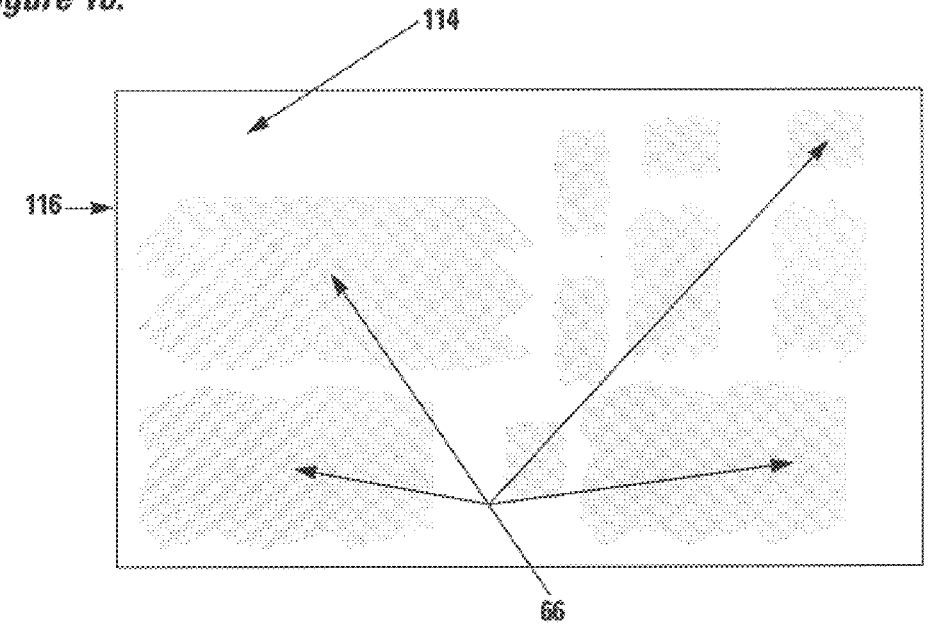
FIG. 16 is a view of the back side of a base material with graphic images printed thereon according to the third method of the present invention.
Figure 17:
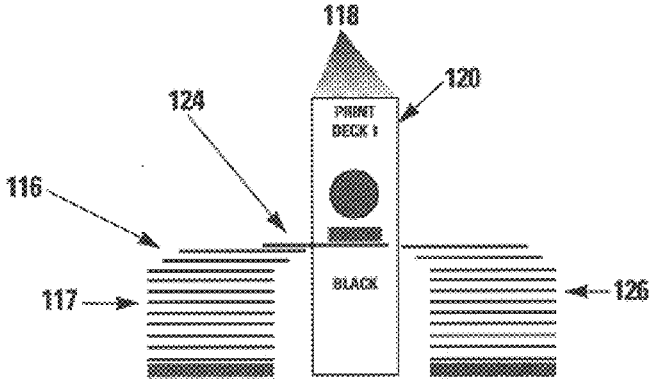
FIG. 17 is a diagrammatic view of a die pattern station in operation according to the third method of the present invention.
Figure 18:
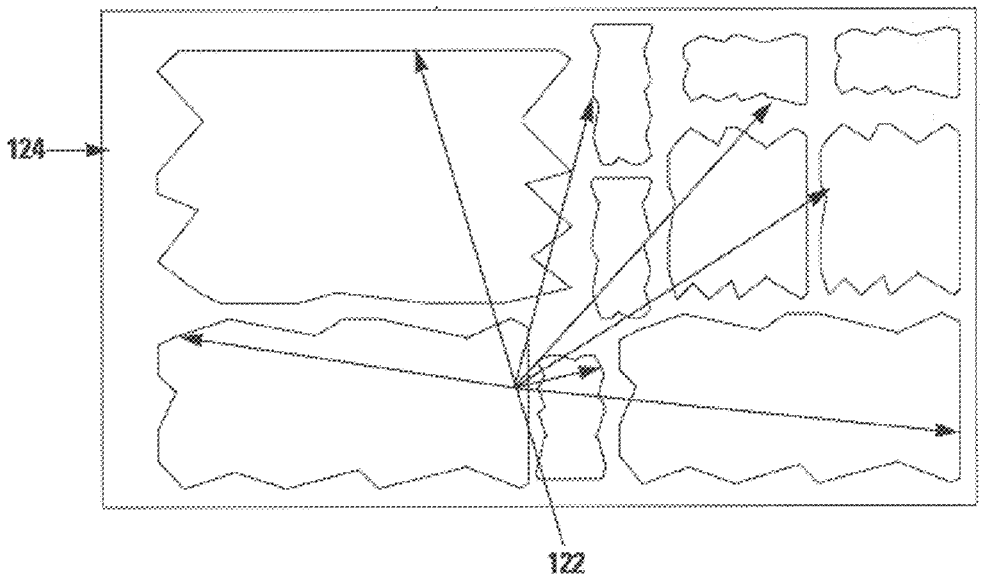
FIG. 18 is a view of the front side of a base material with die patterns printed thereon according to the third method of the present invention.

Referring to FIG. 15, individual sheets 100, preferably constructed of paper, are drawn from a batch 102 and fed through offset lithographic printing apparatus 104, which comprises one or more print decks 106,108,110,112. Each print deck 106,108,110,112 applies a differently colored ink to a print or back side 114 of each sheet 100. Each printed sheet 116 has various images 66 arranged in a manner similar to the images produced in Method 2, as shown in FIG. 16. In the present method, however, it is not necessary to print reversed or mirrored images. The printed sheets 116 are collected into a batch 117 and transferred to a die pattern station 118, which consists essentially of an additional offset lithographic print deck 120 and is shown in FIG. 17. The additional print deck 120 prints a die pattern 122, preferably in black ink, on the front side 124 of each sheet 116 to produce patterned sheets 126. As shown in FIG. 18, the die patterns 122 are in register with the corresponding images 66 printed on the back side 114 and are used as a die-cutting guide for the die-cutting equipment described below.

Figure 19:
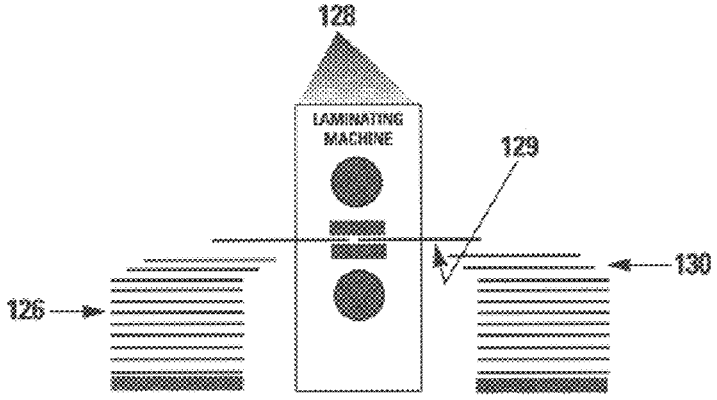
FIG. 19 is a diagrammatic view of a laminating machine in operation according to the third method of the present invention.
Figure 20:
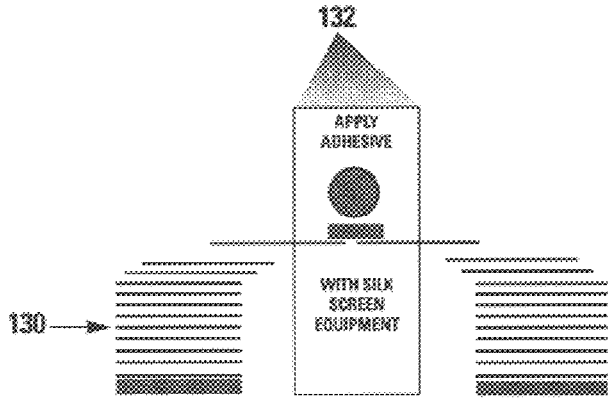
FIG. 20 is a diagrammatic view of adhesive application apparatus in operation according to the third method of the present invention.
Figure 21:
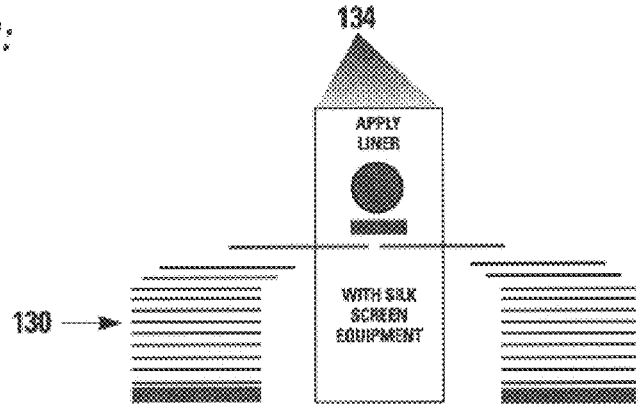
FIG. 21 is a diagrammatic view of liner material application apparatus in operation according to the third method of the present invention.
Figure 22:
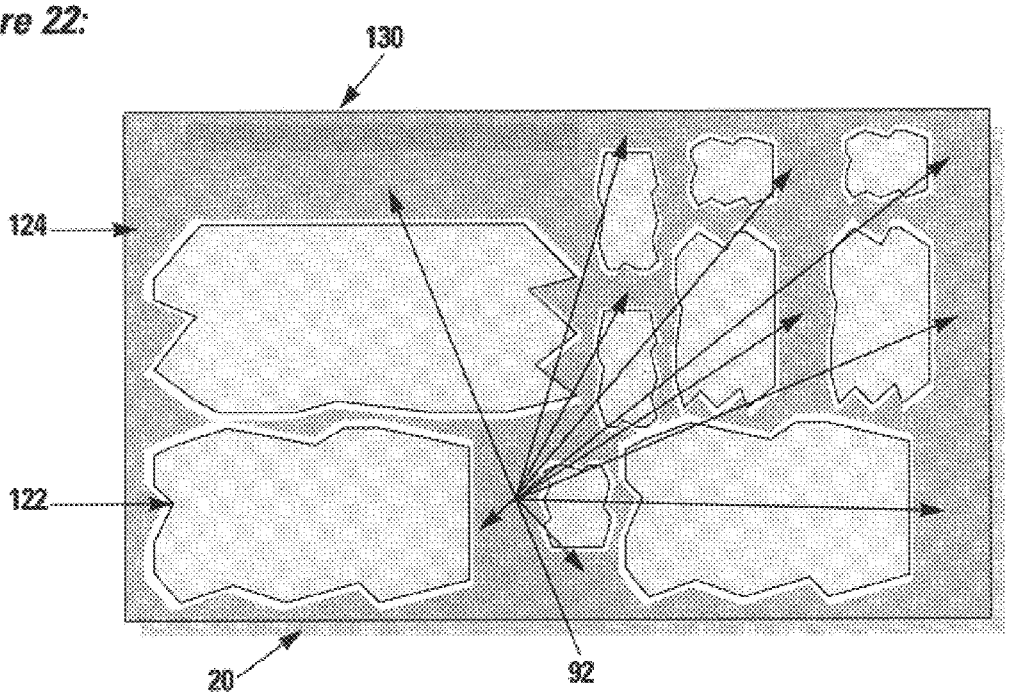
FIG. 22 is a view of the back side of a base material according to the third method of the present invention showing a base material, laminate layer, a pattern pressure sensitive adhesive application, and a liner material.

The patterned sheets 126 are collected and transferred to a laminating machine 128, shown in FIG. 19. The laminating machine 128 applies a clear, rigid laminate layer 129 to the back side 114 of each sheet 126 to form a laminated sheet 130. The laminated sheets 130 are collected and transferred to an adhesive application station 132 of the type typically used in silk screening operations, shown in FIG. 20. A pressure sensitive adhesive is applied in a predetermined pattern to the laminate layer 129 on the back side 114 of each laminated sheet 130. The laminated sheets 130 are then collected and transferred to liner application apparatus 134 shown in FIG. 21, also of the type typically used in silk screening operations. The liner application apparatus 134 further laminates the sheets 130 by applying a releasable liner material 20 to the laminate layer 129. FIG. 22 shows the front side 124 of one of the laminated sheets 130 with the releasable liner material 20 acting as a substrate. Reference numeral "92" designates the locations where the adhesive coatings 86 have been applied adjacent corresponding images 66 on the back side 114.

Figure 23:
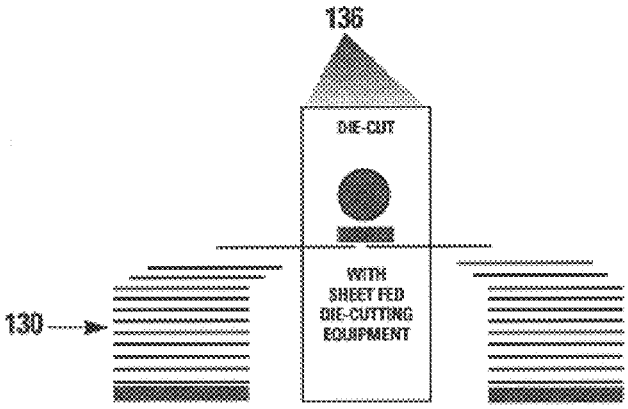
FIG. 23 is a diagrammatic view of die-cutting and scoring apparatus in operation according to the third method of the present invention.
Figure 24:
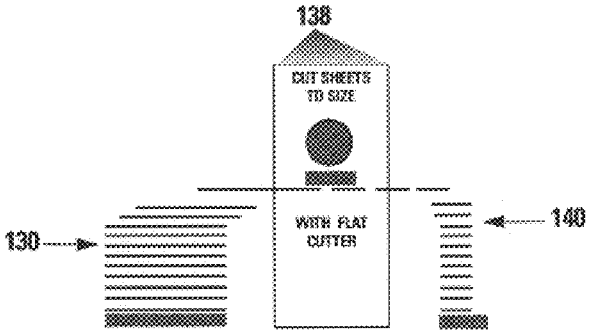
FIG. 24 is a diagrammatic view of sheet cutting apparatus in operation according to the third method of the present invention.
Figure 25:
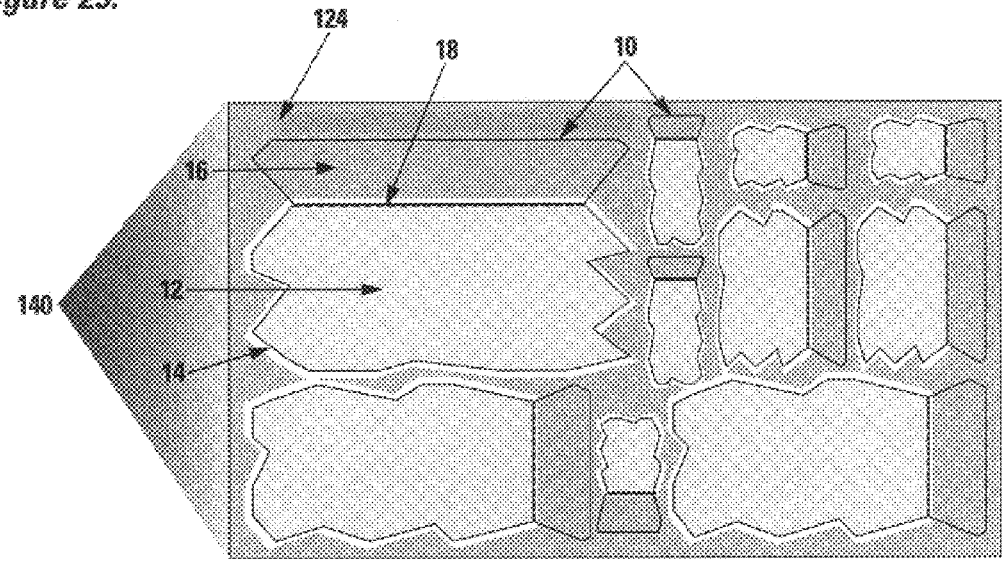
FIG. 25 is a front view of a laminated sheet having die-cut outlines and perforated or scored lines according to the third method of the present invention; and, FIG. 26 is a diagrammatic view of a sticker constructed according to the third method of the present invention showing the relationships between layers, adhesive coating and color applications.

Once the laminated sheets 130 have each been provided with the releasable liner material 20, the sheets 130 are transferred to a die-cutting station 136, shown in FIG. 23, where the sheets 130 are die-cut and perforated in a manner analogous to the finishing operations described above in relation to Methods 1 and 2. Again, the die or dies used may be nicked. Also, a scoring step may be elected in place of perforation. As shown in FIG. 24, the sheets 130 are then run through sheet cutting apparatus 138 such as a flat cutter and trimmed or cut to a finished size. Preferably, a finished sheet 140 will have a length of 7.25" and a width of 4". FIG. 25 shows the front side 124 of the finished sheet 140. The die-cutting operation results in an outline 14 cut about each printed image 66 and corresponding adhesive coating 86 to define figure and base portions 12,16. The die-cutting operation also creates a perforated line 18 between each figure and base portion 12,16. As in the case of Methods 1 and 2, the resulting set of varied stickers 10 on each sheet 140 are preferably thematically related.

Figure 26:
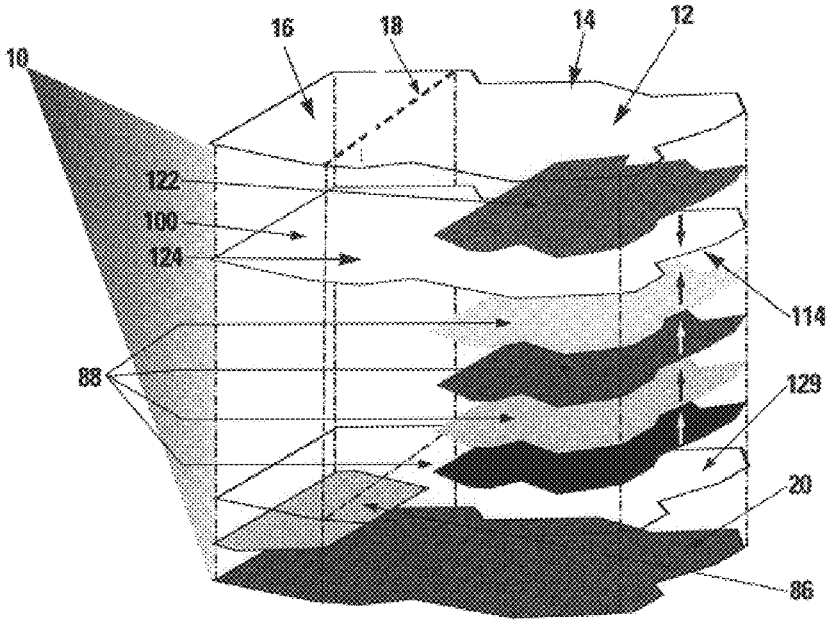

FIG. 26 diagrammatically summarizes the construction of the finished sticker 10 with its several layers shown in exploded view. As described, the sticker 10 is based on the original sheet 100 which is preferably a paper layer. The paper layer 100 has a black die pattern 122 printed on its front side 124 and a series of differently colored ink applications 88 on its back side 114 which result in the figure or graphic image 66. The paper layer 100 is laminated with a clear, rigid laminate layer 129 on the printed back side 114, and a pressure sensitive adhesive coating 86 exists on the base portion 16 of the laminate layer 129. The finished sticker 10 is in releasable contact with the liner material 20 on the side of the laminate layer 129 carrying the adhesive coating 86.

It will be understood that the present method may be modified such that each sheet 130, before it is run through the cutting apparatus 138, contains a plurality of sets or groups of thematically related stickers 10. For example, each sheet 130 may contain four groups having the same theme or four groups having different themes. In such a case, the cutting apparatus 138 would be used to divide each sheet 130 into smaller individual sheets that each contain only one group of stickers 10.

It should be noted that because all of the needed operations must be accomplished individually and off-line, Method 3 is much more costly than the Methods 1 and 2, especially where large-quantity production runs are contemplated. While reproduction by the offset lithography process in Method 3 is superior as compared the flexographic printing methods of Methods 1 and 2, in many situations the improved print quality will not justify the significant cost difference. At present, it is believed that Method 3 is viable cost-wise only for low-quantity production runs. Thus, Method 2 is considered overall to be the best method described herein for the efficient production of standable stickers 10 of commercially acceptable quality.

It will be understood that application of the stickers 10 produced by the above-described methods is not limited to the coated display surface 24. Alternatively, where repositionability or rearrangement of the stickers 10 is not contemplated, the stickers 10 described herein may be permanently adhered to surfaces such as paper stationery.

It will also be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A standable sticker comprising an integral one-piece shape including:

a figure portion having opposing nonadhesive front and rear surfaces; and a base portion comprising a unitary member having an adhesive contacting surface and a nonadhesive upper surface wherein a line defines a boundary between the figure portion and the base portion, and the figure portion is foldable at an angle relative to the base portion at the line to permit the figure portion to be presented in a substantially vertical orientation, and, wherein the base portion is connected to the figure portion solely at a connection area along the line, and the figure portion derives support solely from the base portion.

2. The sticker of claim 1 wherein the figure and base portions are constructed of a cellulosic material.

3. The sticker of claim 1 wherein the figure and base portions are constructed of a polymeric material.

4. The sticker of claim 1 wherein the base portion includes an adherable side coated with a pressure sensitive adhesive.

5. The sticker of claim 1 wherein the figure portion has a first side and the base portion has a second side, the first and second sides adapted for releasable adhesion to a liner material.

6. The sticker of claim 1 wherein the base portion is removably adherable to a surface coated with silicone compound.

7. The combination of the sticker of claim 1 and a display surface, wherein the base portion is removably adherable to the display surface which is coated with an ultraviolet radiation treated compound after initial removal of the base portion from a liner material.

8. The sticker of claim 1 wherein the line is perforated.

9. The sticker of claim 1 wherein the line is scored.

10. The sticker of claim 1, wherein the sticker is standable upon placement of the base portion on a single planar display surface, independent of manipulation of the display surface.

11. The combination of the sticker of claim 1 and a display surface, wherein the sticker is removably adhered to the display surface after initial removal of the base portion from a liner material.

12. A standable sticker comprising an integral one-piece shape consisting of:

a figure portion having opposing nonadhesive front and rear surfaces; and a base portion comprising a unitary member having an adhesive contacting surface and a nonadhesive upper surface wherein a line defines a boundary between the figure portion and the base portion, and the figure portion is foldable at an angle relative to the base portion at the line to permit the figure portion to be presented in a substantially vertical orientation, and, wherein the base portion is connected to the figure portion solely at a connection area along the line, and the figure portion derives support solely from the base portion.

* * * * *